US005109618A

United States Patent [19]

Grübler et al.

[11] Patent Number: 5,109,618

[45] Date of Patent: May 5, 1992

[54] SNOW-PLOW

[75] Inventors: Walter Grübler, Brannenburg, Fed. Rep. of Germany; Kurt Kopp, Kufstein, Austria

[73] Assignee: Martin Beilhack Maschinenfabrik und Hammerwerk GmbH, Rosenheim, Fed. Rep. of Germany

[21] Appl. No.: 466,325

[22] PCT Filed: Nov. 13, 1988

[86] PCT No.: PCT/EP88/01035

§ 371 Date: May 8, 1990

§ 102(e) Date: May 8, 1990

[87] PCT Pub. No.: WO89/04892

PCT Pub. Date: Jun. 1, 1989

[30] Foreign Application Priority Data

Nov. 14, 1987 [DE] Fed. Rep. of Germany ..... 3738734
Mar. 10, 1988 [DE] Fed. Rep. of Germany ..... 3808002

[51] Int. Cl.[5] ..... E01H 5/04

[52] U.S. Cl. ..... 37/232; 37/271; 403/328

[58] Field of Search ..... 37/232, 233, 266, 271, 37/270; 172/264, 265, 270, 260.5; 403/328, 327, 377

[56] References Cited

U.S. PATENT DOCUMENTS

| | | | |
|---|---|---|---|
| 3,626,614 | 12/1971 | Kahlbacher | 37/232 |
| 3,650,054 | 3/1972 | Hanson | 37/232 |
| 3,775,877 | 12/1973 | Gove, Jr. | 37/232 X |
| 4,843,744 | 7/1989 | Jansen | 37/232 |

FOREIGN PATENT DOCUMENTS

| | | |
|---|---|---|
| 2145215 | 1/1973 | Fed. Rep. of Germany . |
| 3542479 | 6/1987 | Fed. Rep. of Germany . |
| 2017871 | 10/1979 | United Kingdom . |

*Primary Examiner*—Randolph A. Reese
*Assistant Examiner*—J. Russell McBee
*Attorney, Agent, or Firm*—Nixon & Vanderhye

[57] ABSTRACT

Snow-ploughs for frontal mounting on road vehicles are provided with an avoidance device, which in known types can be implemented by means of two circular curved guides. This poses problems, however, during mounting as well as during avoidance, particularly on hard surfaces. In order to ensure firm and reliable mounting of the plough blade (1) on the curved guide and hence problem-free avoidance, the curved guide is designed as a sliding bearing. To this end, it comprises a first and a second curved actions. A forced limiter with a descending characteristic curve is also provided. The snow-plough is suitable for use as road snow-plough.

15 Claims, 7 Drawing Sheets

SNOW-PLOW

BACKGROUND OF THE INVENTION

The invention relates to a snow plow.

A snow plow of the general nature of the present invention is disclosed for example, in German Published, Non-examined Patent Application DE-OS 21 45 215. This snow plow has on the back of each blade two lateral curved guides. This curved guidance is intended to assure that, when an obstacle on the ground is encountered, the respective blade is turned out around the center of the curved guidance in respect to the obstacle, the scraping edge driving up against the obstacle first being pivoted towards the back and then being lifted up on the curve of the circle so that the obstacle can be overridden.

The respective blade is maintained and returned into the initial position by a plurality of spring tension devices.

In connection with the foregoing known snow plow, a connection at only a point or line is made because of the specific curved guidance, even if bearing rollers are used. In case of particularly heavy snow removal, however, the forces acting on the supports are strong enough that they result in not inconsiderable damage and disadvantages. Moreover, problems arise in connection with the setting of the restoring force and with the return of the blade into the operational position once it has been deflected. A relatively large pivot path is traversed in the course of the deflection movement of the blade, in the course of which the spring elements, which act on the top of the back of the blade, are stretched over a large travel of the spring. This then means that the restoring force further increases, dependent on the spring travel. A compromise is hard to find in actual use to, on the one hand, be able to set the release forces as high as possible in case of hard removal and, on the other, not to allow the restoring forces, which further increase with the stretching of the restoring springs, to become too great.

It is therefore the object of the present invention to overcome the disadvantages of the state of the art and to further providing an improvement snow plow which affords increased support, and deflection movements without problems throughout the full range of the deflection movement.

A curved slide bearing is used for the first time with the snow plow of the present invention, which results in all-over support and force absorption. Because of this, and especially with heavy removal, the occurring forces can be supported and absorbed without problems and without leading to an impairment of the bearing elements. Because of the additional use of a force limiter it is possible to set the triggering forces without problem when a ground obstacle is encountered. The force limiter has the further considerable advantage that after the triggering forces have been overcome, the characteristic magnitude of force, for all practical purposes, abruptly drops down to another, preset and much lower value in order to perform the pivot movement of the blade to the end without problem after driving up against an obstacle on the ground and overcoming the triggering force. This makes possible a safe crossing over the ground obstacle.

In a particularly preferred embodiment it is of course also possible to provide slide bearings for the lateral support of each one of the blades.

The use of a first curved segment and a second one cooperating with it has proven particularly advantageous. These are designed to interact in the manner of a groove/spring connection and thus are captively guided slidingly in respect to each other. In this way the lateral forces are also being absorbed.

Plastics are particularly suitable as materials for the slide bearing.

In the snow plow of the invention it is possible without problems to change and pre-set the pitch angles of the scraper edge. For this purpose the position of the force limiter, which is supported at least indirectly between one blade and the support frame, can be changed at least at one connecting point, by means of which the angular position of the deflectable blade and thus the pitch angle of a scraper edge are determined. The adjustment can be performed remotely controlled either mechanically or hydraulically, pneumatically or by an electric motor, for example by means of an eccentric, a worm, etc. Mechanical as well as hydraulic or pneumatic designs can be considered as force limiters.

In accordance with an improvement of the invention, a force limiter is used which operates not in the sense of an extension, but in the sense of a shortening when a triggering force takes effect and which for this purpose is preferably disposed in the lower area of the blade. It consists of a connecting link of an elastomeric material which may be in the shape of a strap, for example.

With an appropriate adjustment, maximum triggering forces are generated at the start by means of this connecting link of elastomeric material, the pivoting into a deflection position only being possible when the triggering forces are exceeded. After the triggering forces have been exceeded, here, too, the elastomeric connecting link is being increasingly curved, the forces permitting further deflection of the blade are less by far than the triggering forces to be exceeded at the start.

The direction and place of the curving operation is also determined by the slightly arced curve in the initial position.

Thus the present invention has decisive advantages in comparison with the already known devices. Conventional restoring springs had to be made large and strong. This was necessary to assuredly and quickly return the blade, which was suspended in a curved guide, from its deflection into its scraping position after a deflection maneuver had been performed. Furthermore, it was also necessary to set the desired high triggering forces by means of the restoring springs. Not only were the large size restoring springs expensive, they also have the additional disadvantage that, when the triggering force has been attained, with increased pivoting of the blade into the deflection position the springs are further stretched and thus the resilience which must be overcome in the direction of deflection increases even more.

In contrast thereto, a force limiter is proposed by the design of the invention where the triggering forces can essentially be set independently of a restoring spring device and where it is also assured in a particularly advantageous manner that, when the triggering force has been attained and overcome, the further adjustment movement into the deflection position can take place without problems, because the further adjustment forces to be overcome after exceeding the triggering force do not increase, but diminish rapidly or are kept at a low level.

BRIEF DESCRIPTION OF THE DRAWING FIGURES

Further advantages, details and characteristics of the invention ensue from the following exemplary embodiments shown by means of the drawings wherein.

DETAILED DESCRIPTION OF A PREFERRED EMBODIMENT

Figure 1:
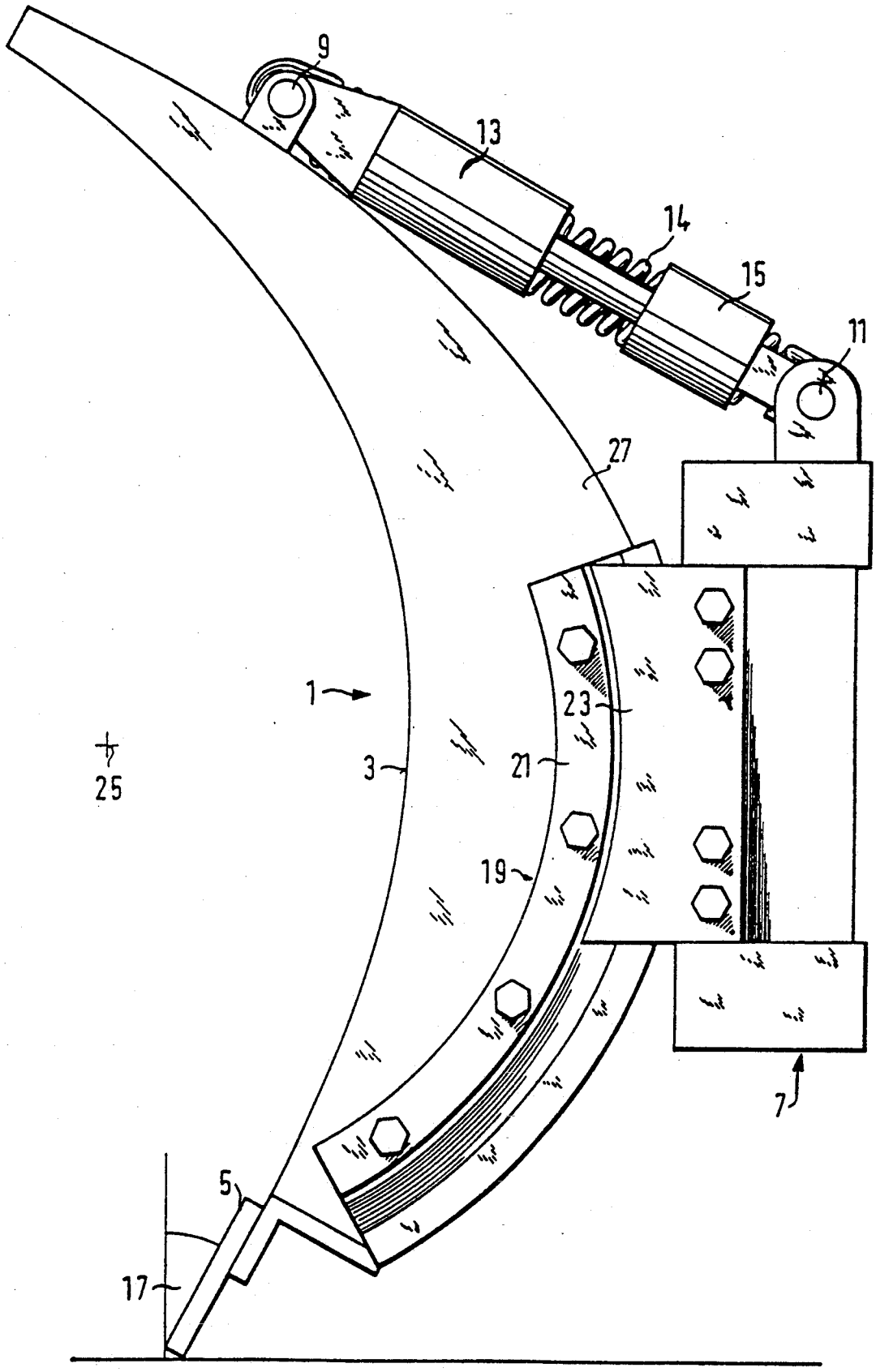
FIG. 1 is a schematic cross-sectional view of a blade in a lower operating position.
Figure 2:
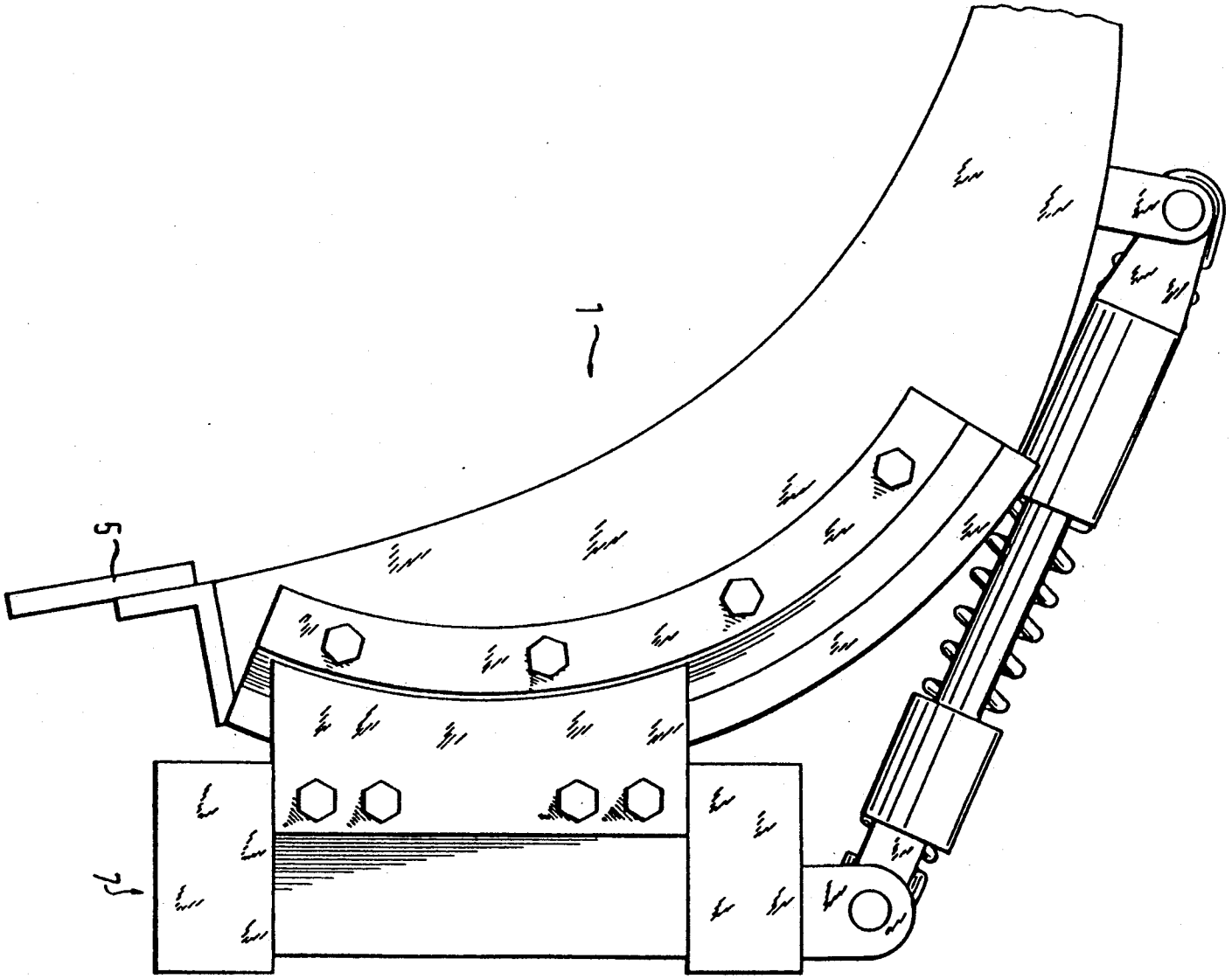
FIG. 2 is a blade in accordance with FIG. 1 in its raised deflection position.

In FIGS. 1 and 2, a blade 1 with a front clearing surface 3, concave in the direction of movement, and a lower scraper edge 5 are shown in a schematic lateral view of the snow plow. The blades 1, several as a rule, are supported deflectably on a support frame 7 which, in turn, can be suspended from the front of a motor vehicle by means of a height adjustment, not further shown, and a subsequent holding or equipment plate.

Between a forward linking point 9 on the back of a blade and a rear linking point 11 on the support frame 7, at least one force limiter 13 and a restoring device 14, for example in the shape of a spring which acts between the frame and the blade, for each blade 1 is mounted, which can be adjusted in position preferably via an adjusting device 15. It is possible to pre-set a pitch angle 17 of the scraper edge 5 in respect to the vertical of the plane of the road by means of extending or shortening the adjusting device 15.

As can be seen from the drawings, each blade 1 is deflectably held on the support frame via a curved guide 19. For this purpose a curved guide 19 is disposed on the back of each blade, preferably at its lateral edge, which consists of a first and second curved segment. The radius of the curved guide 19, i.e. the first and second curved segment 21 and 23, is less in the exemplary embodiment shown than the lower, changing curved radius of the clearing surface 3. Moreover, the radius of the curved guide 19 has been selected such that the associated center 25 is located at the height of or in front of the contact straight line of the scraper edge 5 on the surface. In this way it is assured that in the course of encountering a ground obstacle the respective blade 1 does not press down on the surface, but is immediately lifted simultaneously with backward pivoting above the curved guide in order to avoid the ground obstacle in this way, as is illustrated in a second deflection position in FIG. 2.

Figure 3:
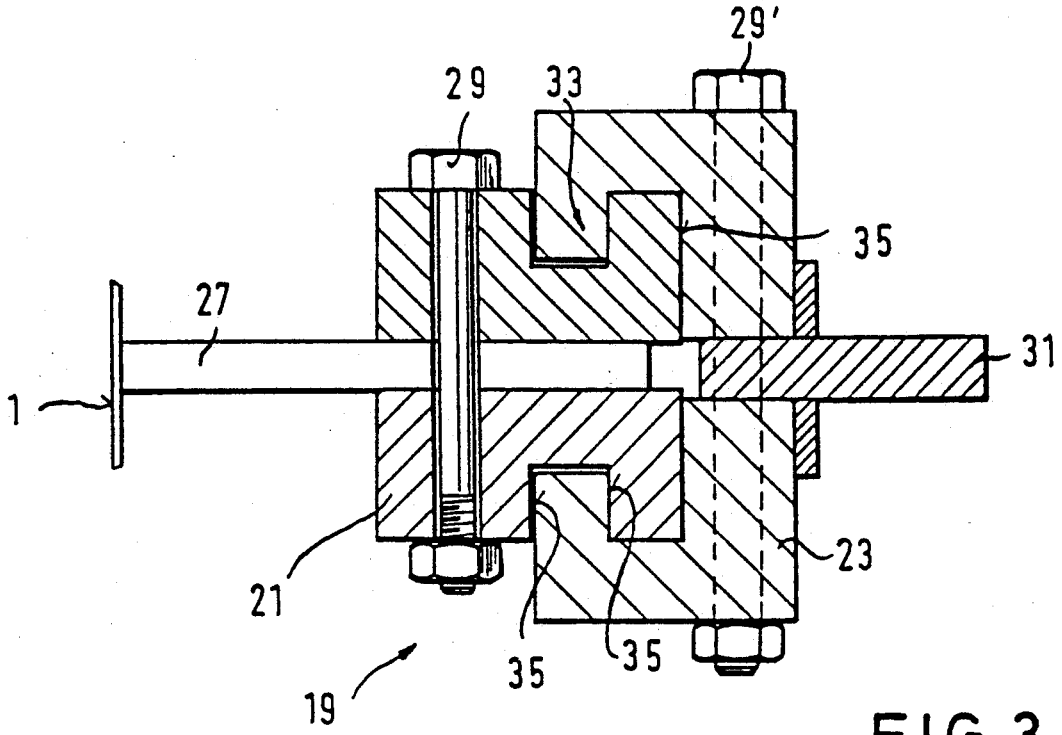
FIG. 3 is a schematic, excerpted cross-sectional view of a slide bearing.

It can be seen from the cross-sectional illustration of FIG. 3, that a rib 27 extending to the back is provided in the vertical lateral area on the back of a blade 1, on which the one first curved guide 21, consisting of two parts, is fixed by means of screws 29. The second curved guide 23 is fixed on the support frame 7 via a support member 31 by means of screws 29'. The two curved sections 21 and 23 are captively guided, interlockingly, via spring/groove catches 33 which are in the shape of an arc of a circle. Plastic with low friction and high sliding ability is particularly suitable as a material, such as polyethylene, particularly with a high polymerization degree.

Based on the described structure it is immediately clear that it is possible, when encountering a ground obstacle, that the forces directed to the blade are absorbed over the full width of the curved sliding surface 35 between the first and second curved section 21 and 23, so that damage and impairment of this slide bearing is impossible for all practical purposes. Furthermore, by means of the spring/groove catch 33, laterally acting forces are absorbed and supported, for which reason a plurality of blades guided next to each other are guided with extreme exactitude, so that lateral deflection is completely avoided for all practical purposes. It is also possible to provide an upper and lower stop for safety's sake, by means of which the maximum curved deflection is limited.

Figure 4:
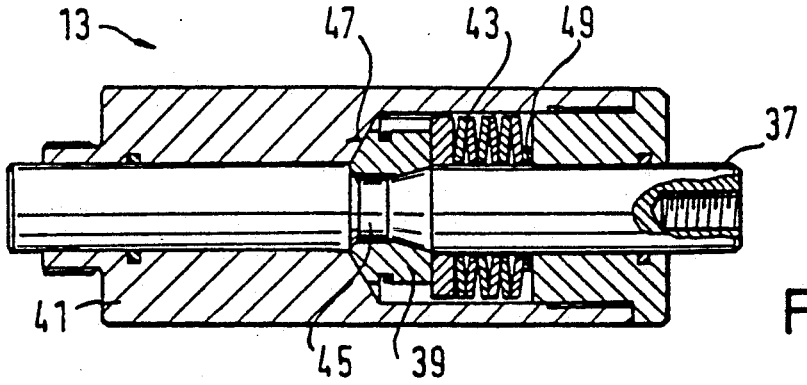
FIGS. 4 and 5 are cross-sectional views of a mechanical force limiter in two setting positions.
Figure 5:
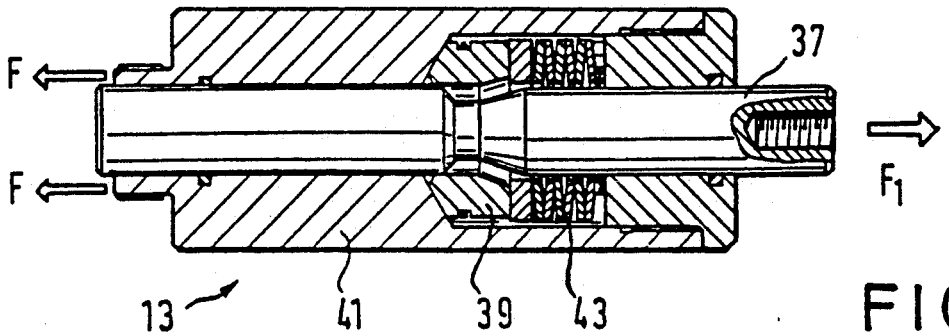

A mechanically operating force limiter 13 will be described in detail with respect to FIGS. 4 and 5.

It can be seen from these drawings figures that a rod 37 is connected with a housing 41 via locking elements 39. The locking elements 39 are pressed via the disk spring assembly 43 into a groove 45 of the rod 37 and against conical surfaces 47 formed on the housing 3. If a force is acting between the rod and the housing, no movement takes place between the two parts until the triggering force is attained. If the force is increased, the rod 37 moves in relation to the housing 41, so that the total distance between the two linking points 9 and 11 is increased and in this way the blade 1 can be pivoted counterclockwise around the center 25 of the curved guide 19. Immediately after exceeding the triggering force, however, the force acting and required in the force limiter 13 for further longitudinal changes immediately drops to a much smaller, adjustable value.

The triggering force can be easily set by a change in the amount of disks 49 for the disk spring assembly 43. Although the energy accumulator shown operates in both directions (and here with varied triggering forces), it is possible to use in the present exemplary embodiment a unilaterally acting force limiter.

Thus, use of the force limiter makes heavy removal possible, because it is possible to set optionally high triggering forces and the snow plow blade is not deflected until they have been reached. After exceeding the triggering force, however, the characteristic curve in the force limiter 13 drops so clearly that it is possible to pivot the blade away from the ground with small force up to its maximum, final position. Reverse pivoting takes place by means of a restoring device 14 which may consist, for example, of a relatively small-sized restoring spring.

As explained, the adjustment angle 17 can be pre-set by a device which is schematically illustrated as adjusting device 15. This can be done, for example, by moving the rear or front linking point 9 or 11 to another bore between the force limiter 13 via a manually operated bolt support. However, a motorized, electrical, pneumatic or hydraulic adjustment is also possible in order to be able to set any optional pitch angle, for example, from the cab. This can take place, for example, via an eccentric or a motor-driven worn, in order to optionally be able to set the distance between the linking points 9 and 11, or the position of a linking point, and thus the pitch angle 17.

A changed exemplary embodiment will be described below by means of FIGS. 6 to 9, like parts having the same reference numerals. The exemplary embodiment described below differs from the exemplary embodiment explained above in that, in place of an upper energy accumulator or force limiter 13, a lower energy accumulator or limiter 13 is used, which is comprised by a lower elastomeric connecting member 13'.

Figure 8:
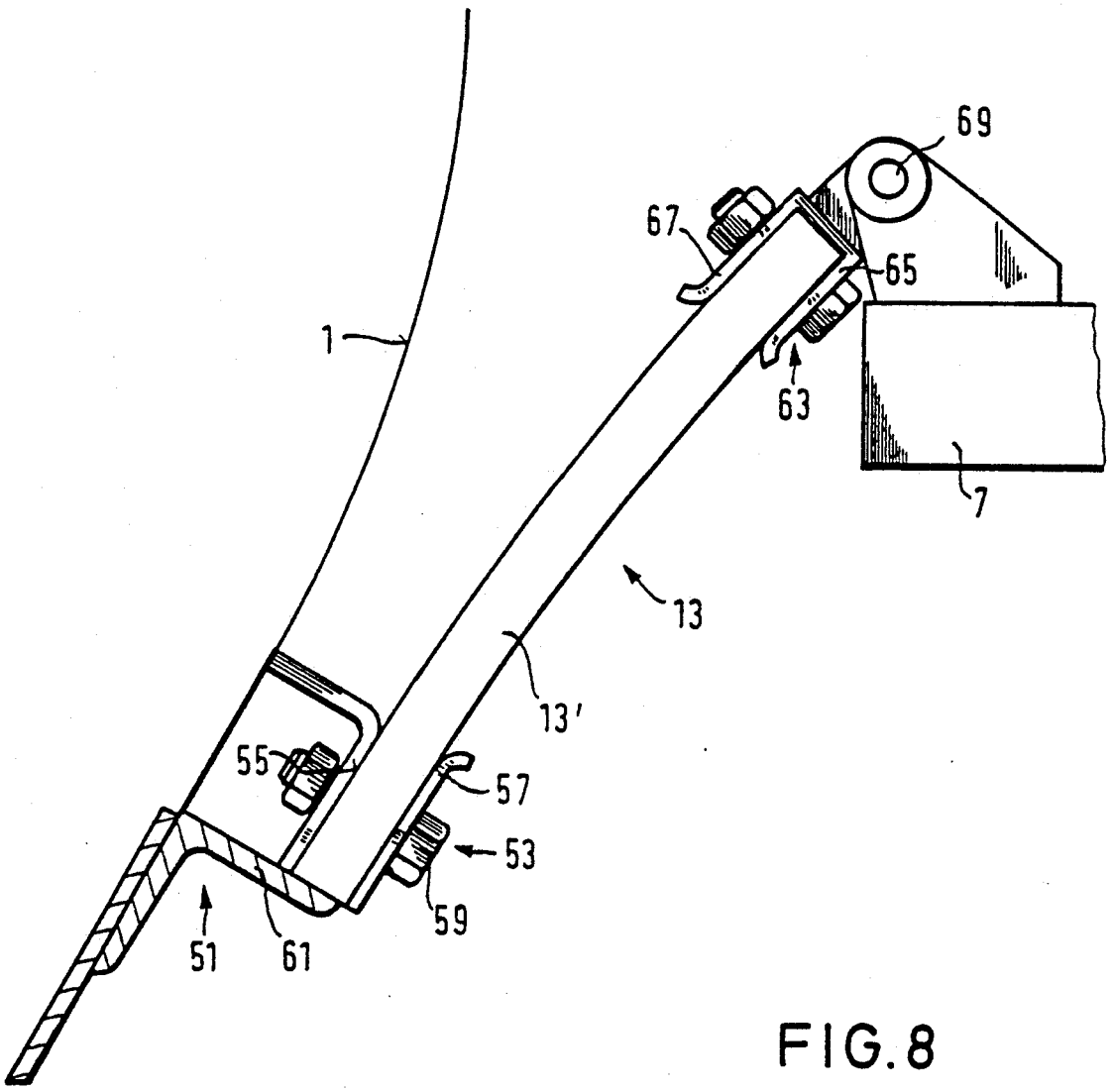
FIG. 8 is a schematic excerpted cross-sectional view of the energy accumulator in the form of an elastomeric connecting link acting on the lower part of the blade.
Figure 9:
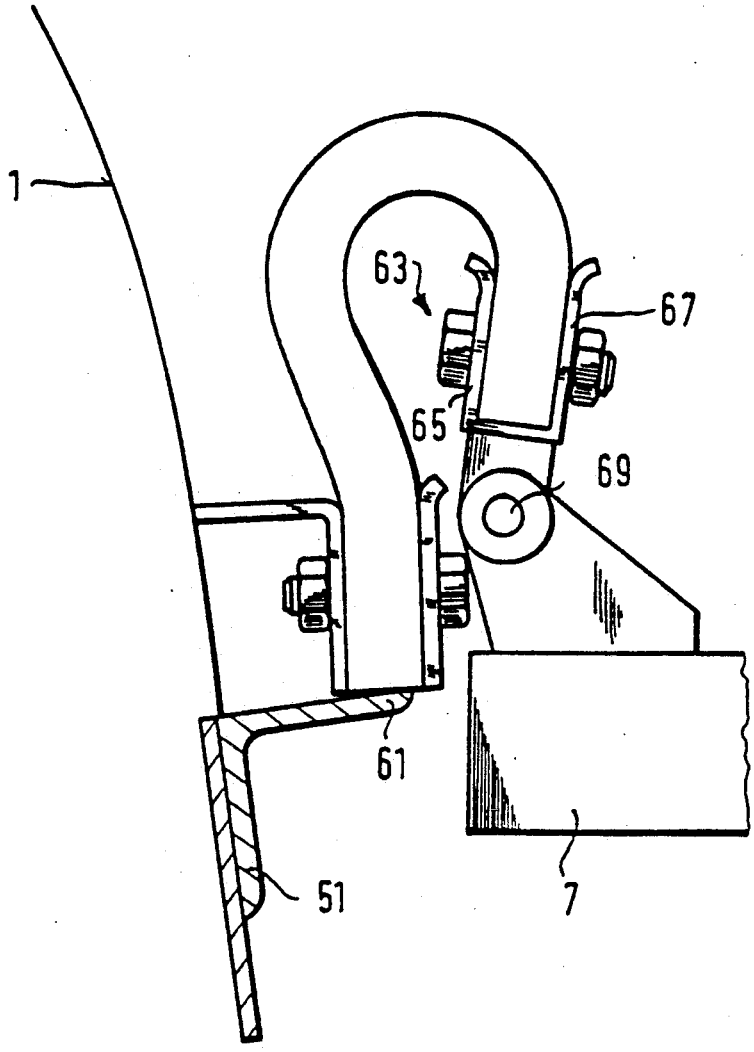
FIG. 9 is the setting and disposition of the lower energy accumulator consisting of an elastomeric material in the deflection position of the blade.

This connecting member 13', shown in FIGS. 8 and 9, is clamped by means of screws 59 at a forward end directly on the lower edge of the blade on an angle iron 51 on the back of the blade to a fastening means 53 disposed there between an abutment surface 55 and a support rail 57. In other words, the end of the connecting member 13' made of an elastomeric material is clamped sandwich-like between the abutment surface 55 and the support rail 57, the screws 59 extending through the corresponding bores through this sandwich construction. At the front the support is achieved by means of the rearward extending leg 61 of the angle iron 51.

The alignment of the abutment surface 55 takes place almost tangentially to the corresponding curved section of the front blade. In the exemplary embodiment shown, the angle deviates by 5° from the lower tangent of the blade curvature. Angles from 0° to 20°, preferably 2° to 15° or 10°, mainly around 4° to 6°, are very suitable.

A support and a bearing device 63 is also provided for the back end of the connecting members made of an elastomeric material which comprises an angular rail 65 and an opposite rail 67, which again sandwich-like surround the connecting member 13' between them and support the front end of the connecting member with the one obliquely extending leg of the angular rail 65. Again, fastening is accomplished by means of screws extending crosswise through the entire device and which are not further shown in the exemplary embodiment illustrated.

In contrast to the forward support and bearing device 54, the rear support and bearing device 63 provided on the respective support frame 7 is flexibly suspended by means of a hinge pin 69 on the support frame 7.

In the plowing position the elastic energy accumulator 13' in the shape of an elastomeric connecting member takes up the slightly curved pre-stressed basic position shown in a cross-sectional view in FIG. 8. The curvature and curved position in the deflection position is set by the slight curved pre-stressing with the convex curvature in the direction towards the back of the blade.

The triggering force is determined by means of the at least almost tangential positioning and corresponding to the selected material and dependent on the geometric shape of the connecting member 13'. Only after exceeding the triggering force, however, the characterizing power line immediately drops, so that further pivoting then can take place without problems, the end position of the energy accumulator 13' comprised of an elastomeric material being mainly shown in FIG. 5.

Figure 6:
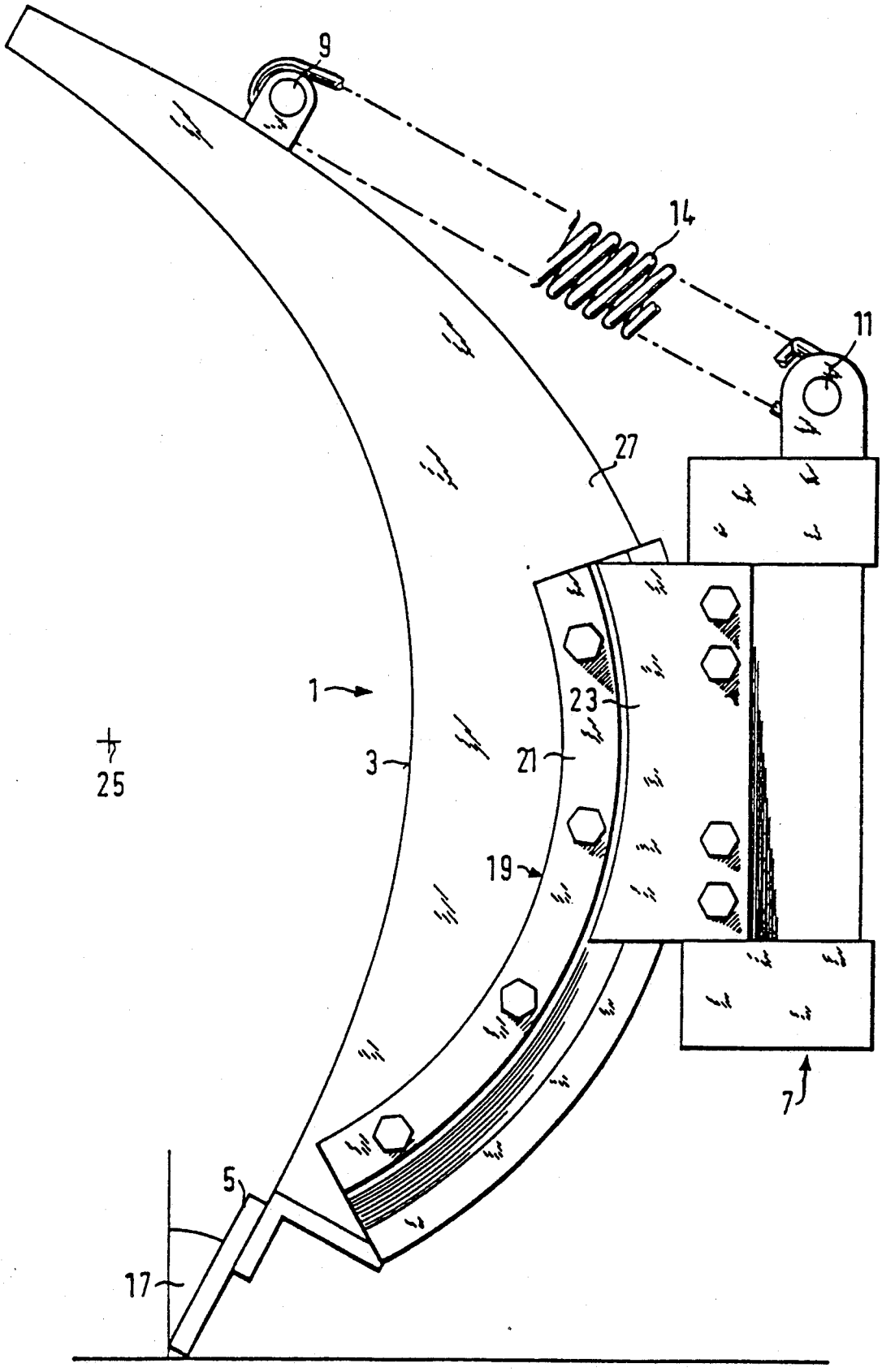
FIG. 6 is a schematic cross-sectional view of a blade in a lower operating position in a changed exemplary embodiment.
Figure 7:
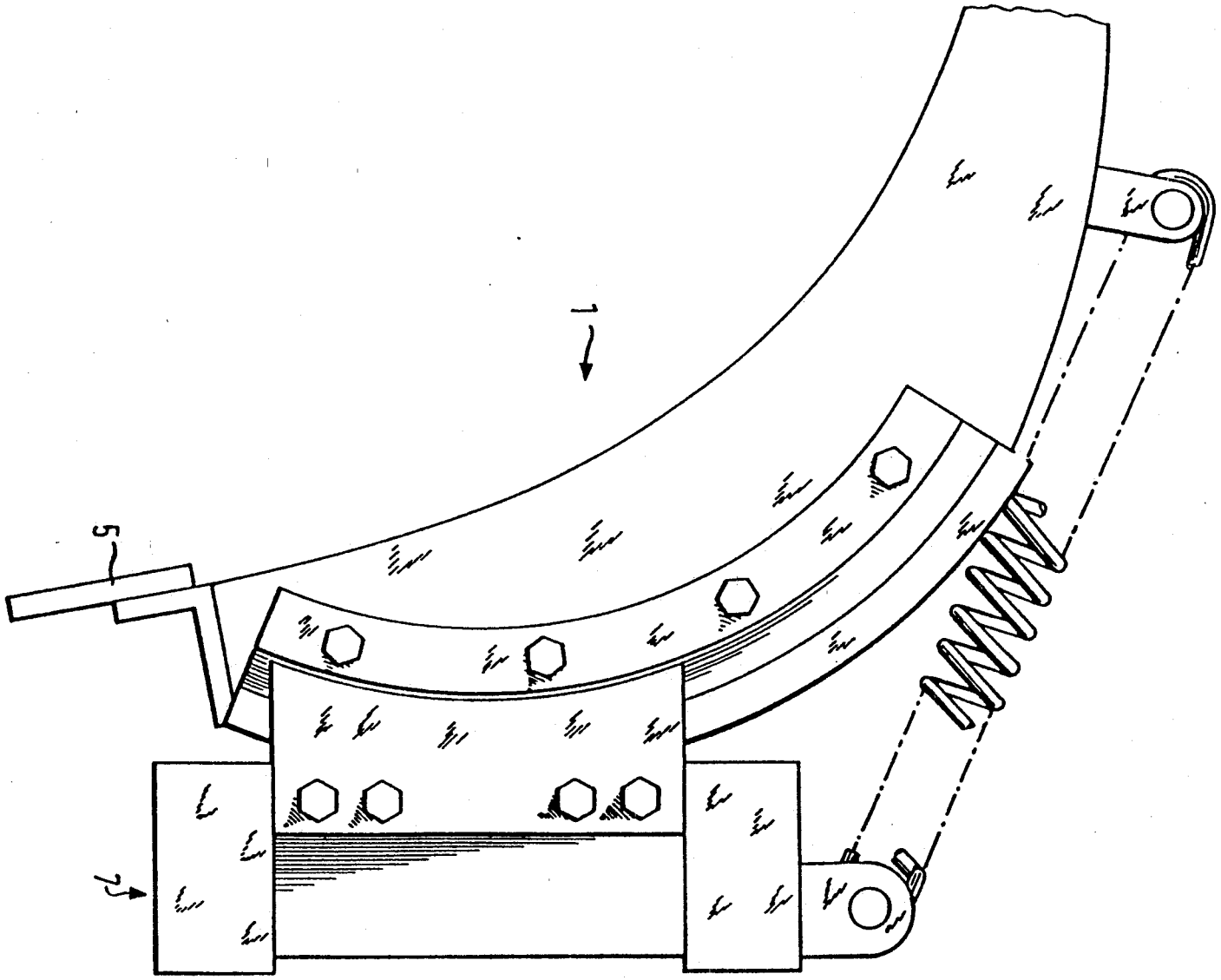
FIG. 7 is a blade in accordance with FIG. 6 in its raised deflection position.

The restoring spring 14 shown in FIGS. 6 and 7 can be set or selected in its base position with only slight pre-stressing, because in the embodiment shown this restoring spring 14 only has the function of returning the blade from the deflected position into the plowing position. In other words, the restoring spring 14 does not have the function of the only or supplemental "triggering energy accumulator," because this would have the disadvantage that springs with high pre-stressing forces would have to be selected which would maintain the blade in the pre-stressed plowing position by means of correspondingly high force.

This, then, during pivoting into the deflection position, would have the further disadvantage that with added tension of the restoring spring its restoring force would further increase, which is exactly what is intended to be avoided.

As a rule, at least one elastic connecting member 13' per deflectable blade is used on the left and right edges respectively.

To be complete, it should be mentioned that basically not only mechanically operating, but for example pneumatically or hydraulically operating force limiters 13 are possible and conceivable. A pressure sensor would be required for this, by means of which the force introduced via the scraper edge are measured and, when a limit value has been exceeded, the pressure in a pneumatic or hydraulic piston, acting as force limiter, would be suddenly released in such a way that a deflecting movement becomes possible. The pressure sensor might be associated, for example, with the pressure chamber of a hydraulically or pneumatically operating force limiting piston in order to be able to measure the introduced plowing forces and to relieve the force limiting piston suddenly. Mechanically operating force limiters, however, are preferred over hydraulically operating force limiting pistons 13, because the latter are slower to change by reason of the inertia of the hydraulic medium.

What is claimed is:

1. A snow plow for a vehicle comprising:

a snow plow blade;

a support frame for securement to the vehicle;

means for connecting said blade and said support frame one to the other enabling pivotal deflection of the blade in one direction relative to said support frame and about an axis upon the blade encountering a ground obstacle;

said connecting means including a pair of generally curved guides on said blade and said support frame defining generally curved, elongated contact surfaces, respectively, relatively slidable about said axis with substantially the entirety of one of said curved elongated contact surface lying in engagement with the other of said curved elongated contact surface throughout the full range of deflection of said blade relative to said support frame about said axis; and a force limiter disposed between said blade and said support frame for preventing substantial deflection of the blade relative to the support frame in response to a force, up to and including a predetermined magnitude of force, applied to said blade by the ground obstacle, tending to deflect the blade in said one direction, said force limiter enabling deflection of said blade in said one direction in response to a force applied to said blade in excess of said predetermined magnitude of force and including means enabling deflection of said blade in said one direction, after exceeding said predetermined magnitude of force, in response to an applied force less than said predetermined magnitude of force.

2. A snow plow according to claim 1 wherein said curved guides comprise a slide bearing supporting the blade against movement in a lateral direction.

3. A snow plow according to claim 1 wherein said curved guides include cooperating flanges and grooves extending in a direction generally parallel to said axis, enabling said blade and said support frame for captive guided movement relative to one another about said axis.

4. A snow plow according to claim 3 wherein said blade includes a pair of ribs extending from a back side thereof and carrying a first pair of said guide surfaces, a second pair of said guide surfaces being carried by said support frame.

5. A snow plow according to claim 1 wherein said contact surfaces are formed of plastic material having a low friction coefficient.

6. A snow plow according to claim 5 wherein said plastic material comprises polyethylene.

7. A snow plow according to claim 1 including means for displacing said blade relative to said support frame in a second direction opposite said one direction.

8. A snow plow according to claim 1 including means carried by said force limiter for enabling setting of the pitch angle of said blade relative to said support frame.

9. A snow plow according to claim 1 including means carried by opposite ends of said force limiter engageable with said blade and said support frame, respectively, enabling a change in the effective length of said force limiter to accommodate variable pitch angles of said blade relative to said support frame.

10. A snow plow according to claim 1 wherein said force limiter includes a connecting member formed of an elastomeric material deformable out of a generally longitudinally extending initial shape in a plowing position of the blade into a deformed curved shape in a deflected position of the blade.

11. A snow plow according to claim 10 wherein said elastomeric connecting member is connected at one end to said blade below the axis of rotation of the curved guides.

12. A snow plow according to claim 11 wherein said elastomeric connecting member is connected at its opposite end to the lower end of the blade.

13. A snow plow according to claim 10 wherein said blade is curved, said elastomeric member is connected at its opposite ends to said blade and said support frame and in said plowing position lies substantially tangentially to the curved shape of said blade.

14. A snow plow according to claim 13 wherein the connection between one end of the elastomeric member and said support frame includes a bearing pivotally coupled to said support frame.

15. A snow plow according to claim 13 wherein said elastomeric member, in the plowing position, is elongated and curved.

* * * * *